US006497333B1

(12) United States Patent
Ellis et al.

(10) Patent No.: US 6,497,333 B1
(45) Date of Patent: Dec. 24, 2002

(54) PANEL STIFFENERS FOR BLOW-MOLDED PLASTIC CONTAINERS

(75) Inventors: Douglas S. Ellis, Neshanic, NJ (US); Aleksey Zats, Fair Lawn, NJ (US); Thomas G. Barlics, Union, NJ (US); Henry H. Nyman, York, PA (US)

(73) Assignee: Paradigm Packaging, Inc., Saddle Brook, NJ (US)

( * ) Notice: Subject to any disclaimer, the term of this patent is extended or adjusted under 35 U.S.C. 154(b) by 0 days.

(21) Appl. No.: 09/680,851

(22) Filed: Oct. 6, 2000

Related U.S. Application Data

(60) Provisional application No. 60/202,584, filed on May 9, 2000.

(51) Int. Cl.[7] ..... B65D 1/02
(52) U.S. Cl. ..... 215/383; 220/671
(58) Field of Search ..... 215/383, 379, 215/381, 382, 385; 220/671, 672, 675, 676, 666, 669, 670; D9/537–550

(56) References Cited

U.S. PATENT DOCUMENTS

| | | | | | |
|---|---|---|---|---|---|
| 4,178,976 | A | * | 12/1979 | Weiler et al. | 150/0.5 |
| 4,316,551 | A | * | 2/1982 | Belokin, Jr. | 220/1 R |
| 4,993,565 | A | | 2/1991 | Ota et al. | 215/1 C |
| D322,212 | S | | 12/1991 | Bourassa et al. | D9/307 |
| 5,101,990 | A | * | 4/1992 | Krishnakunar et al. | 220/670 |
| 5,165,557 | A | * | 11/1992 | Ota et al. | 215/1 C |
| 5,178,289 | A | * | 1/1993 | Krishnakumar et al. | 215/1 C |
| D344,457 | S | | 2/1994 | Prevot et al. | D9/537 |
| 5,598,941 | A | | 2/1997 | Semersky et al. | 215/384 |
| 5,632,397 | A | * | 5/1997 | Fandeux et al. | 215/382 |
| 5,971,184 | A | * | 10/1999 | Krishnakunar et al. | 215/384 |
| 6,016,932 | A | | 1/2000 | Gaydosh et al. | 215/382 |
| D420,592 | S | | 2/2000 | Bretz et al. | D9/520 |
| 6,036,037 | A | * | 3/2000 | Scheffer et al. | 215/381 |
| D427,077 | S | * | 6/2000 | Heliste et al. | D9/543 |
| 6,296,131 | B2 | * | 10/2001 | Rashid | 215/383 |

FOREIGN PATENT DOCUMENTS

| | | | | |
|---|---|---|---|---|
| GB | 2025889 | * | 1/1980 | 215/383 |
| GB | 2161133 | * | 1/1986 | 215/383 |

* cited by examiner

*Primary Examiner*—Lee Young
*Assistant Examiner*—Wen Ngo
(74) *Attorney, Agent, or Firm*—Peter B. Sorell; Mark S. Leonardo; Brown Rudnick Berlack Israels LLP

(57) ABSTRACT

A container is provided which includes a top portion having an opening and a side wall extending from the top portion to an end portion of the side wall. A bottom portion is connected with the end portion of the side wall such that the top portion, the side wall and the bottom portion define an interior space of the container. At least one groove is formed in the side wall. The at least one groove includes a central arc portion and end arc portions. The central arc portion is substantially concave relative to a longitudinal axis of the container. The end arc portions are substantially convex relative to the longitudinal axis of the container. The end arc portions are formed adjacent ends of the central arc portion and communicate with an outer surface of the side wall. Desirably, the at least one groove includes a plurality of grooves. The plurality of grooves may be disposed within the rows in an interrupted configuration such that at least a portion of the outer surface is disposed between the plurality of grooves. The central arc portion and the end arc portion may be cooperatively formed to create a load stress path communicating with the outer surface of the side wall for a load applied to the container. In an alternative embodiment, the at least one groove defines a cross-sectional configuration having groove walls extending inward from the outer surface to a groove floor. The groove walls are oriented at a wall angle measured from the outer surface.

19 Claims, 5 Drawing Sheets

PANEL STIFFENERS FOR BLOW-MOLDED PLASTIC CONTAINERS

CROSS-REFERENCE TO RELATED APPLICATION

This application claims priority from Provisional Application Ser. No. 60/202,584 filed on May 9, 2000, the entire contents of which are hereby incorporated herein by reference.

BACKGROUND

1. Technical Field

The present disclosure relates generally to the field of plastic containers, and more particularly, to panel stiffening features associated with the side walls of plastic containers.

2. Background of the Related Art

Containers such as those described in the present disclosure are used for storing foodstuffs, medicine, liquids, and many other materials. Certain containers must withstand radial side wall forces and axial top loading forces. For example, certain containers must be rigid enough to resist side wall collapse due to internal vacuums that may develop from storing materials therein. Other containers are required to withstand radial forces during label application operations or axial forces during capping operations.

Plastic containers, specifically blow molded plastic containers, are manufactured in various shapes to achieve structural advantages and aesthetic function. Specifically, it is known to provide container side walls with troughs, extensions and decorative shapes to accommodate internal vacuum forces. Inward flexing of the side walls and panels may also be used. The internal vacuum forces occur, for example, when a container is filled with hot material which cools after the container is sealed. Inward flexing of the side walls accommodate volumetric shrinking but create undesirable corner deformations which reduce structural capability to withstand top loads.

One type of container that provides additional top load strength includes ribbing or reinforcement webs. For example, U.S. Pat. No. 6,016,932 to Gaydosh et al. disclose a blow molded bottle having a reduced diameter portion that divides the bottle side panel into first and second portions. The reduced diameter portion is intersected by longitudinal ribs which support top loading, such as installation of push-up caps, by directing stress between the first and second portions. Containers including ribs require additional material that adds to manufacturing cost. Furthermore, they do not prevent side wall deflection or improve overall rigidity.

Certain types of containers must endure external side loads, for example, during labeling operations, storage and transportation. Other containers must overcome the external side load of a handler's grip. See, for example, U.S. Pat. No. 5,598,941 to Semersky et al., disclosing a blow molded container including a pair of depressed areas having reinforcing ribs to form a hand grip.

Some containers require annular stiffness to withstand radial forces that occur due to internal vacuum pressure resulting from hot fill material, changes in altitude and absorption of oxygen within the bottle, e.g., by vitamins or other materials which contain oxygen scavenging materials. Concentric annular grooves are commonly used to provide radial stiffness in container structures, such as in lightweight water bottles, made from PET (polyethylene terephthalate). The annular grooves of these lightweight containers reduce the containers' resistance to top loading, making the containers susceptible to top load crushing.

To overcome this drawback, manufacturers may fabricate the containers with increased wall thickness to provide side load and top load rigidity. Such increased wall thickness, however, requires increased material and mold cycle times, thereby increasing manufacturing cost. Container manufacturers have also attempted to solve strength considerations by including container wall designs to add structural strength. Such designs include decorative shapes and embossed lettering, typically requiring increased material which adds to cost. However, these designs may only provide marginal or incidental increases in structural stiffness.

Therefore, it would be highly desirable to have a simple and economical manner of adding axial and/or side wall deflection rigidity to containers for specific container requirements, shapes and sizes without adding to part complexity or costs of the manufacturing process.

Accordingly, it is therefore an object of the present disclosure to overcome the disadvantages of the prior art by increasing axial and side wall strength and rigidity of plastic containers.

It is a further object of the present disclosure to provide load compensation and increased rigidity of plastic containers in response to externally applied loads.

It is yet another object of the present disclosure, to provide a plastic container that is efficiently and inexpensively manufactured.

Objects and advantages of the present disclosure, set forth in part herein and in part will be obvious therefrom, achieve the intended purposes, objects, and advantages through a new, useful and non-obvious configuration of component elements, at a reasonable cost to manufacture, and by employing readily available materials. The various embodiments contemplated are gleaned from the present disclosure and realized and attained by means of the instrumentalities and combinations pointed out in the appended claims.

SUMMARY

The present disclosure is directed to a container structure having increased strength and rigidity due, at least in part, to at least one groove formed in the container. The container, due to the disclosed configuration, facilitates load compensation and stress relief in response to externally applied loads. The container provides increased structural strength to a container while being easily and efficiently manufactured. The container advantageously forms longitudinal stress paths to facilitate load compensation that increases axial stiffness and top-load strength. The structural improvements of the present disclosure are achieved without substantial increases in material costs, mold cycle time or tooling complexity.

In one particular embodiment, in accordance with the present disclosure, a container is provided which includes a top portion having an opening and a side wall extending from the top portion to an end portion of the side wall. The top portion may include a neck portion. A bottom portion is connected with the end portion of the side wall such that the top portion, the side wall and the bottom portion define an interior space of the container. At least one groove is formed in the side wall. At least one groove includes a central arc portion and end arc portions. The central arc portion is substantially concave relative to a longitudinal axis of the container. The end arc portions are substantially convex relative to the longitudinal axis of the container. The end arc portions are formed adjacent ends of the central arc portion and communicate with an outer surface of the side wall. The central arc portion and the end arc portions may be formed having a substantially undulating cross-sectional configuration.

Desirably, the at least one groove includes a plurality of grooves. The plurality of grooves can form rows along the outer surface of the side wall. The rows lie in planes transverse to the longitudinal axis of the container. In an alternate embodiment, the plurality of grooves are disposed within the rows in an interrupted configuration such that at least a portion of the outer surface is disposed between the plurality of grooves. The rows can lie in parallel transverse planes relative to the longitudinal axis of the container. The plurality of grooves may be disposed in the rows in a relative staggered configuration.

In another embodiment, the central arc portion forms a circle having a first radius and the end arc portions form circles having a second radius and a third radius, respectively. The first radius can be greater than the second radius and the third radius. Alternatively, the second radius and third radius may be substantially equal. In another embodiment, the first radius is measured from an axis offset from the longitudinal axis of the container. The at least one groove may be substantially linear or, alternatively, may have a substantially undulating configuration.

The central arc portion and the end arc portions may cooperatively form a load stress path communicating with the outer surface of the side wall for a load applied to the container. The central arc portion can communicate a load stress against a load stress communicated from the end portions along the load stress path. The at least one groove may define a cross-sectional configuration having groove walls extending inward from the outer surface to a groove floor. The groove walls are oriented at a wall angle measured from the outer surface. The wall angle, desirably, measures 90 degrees. The at least one groove can define a cross-sectional configuration having groove walls extending inward from the outer surface to a convergence position such that the at least one groove has a substantially V-shaped cross-sectional configuration.

BRIEF DESCRIPTION OF THE DRAWINGS

The objects and features of the present disclosure, which are believed to be novel, are set forth with particularity in the appended claims. The present disclosure, both as to its organization and manner of operation, together with further objectives and advantages may best be understood by reference to the following description, taken in connection with the accompanying drawings, in which:

DETAILED DESCRIPTION OF THE EXEMPLARY EMBODIMENTS

Figure 1:
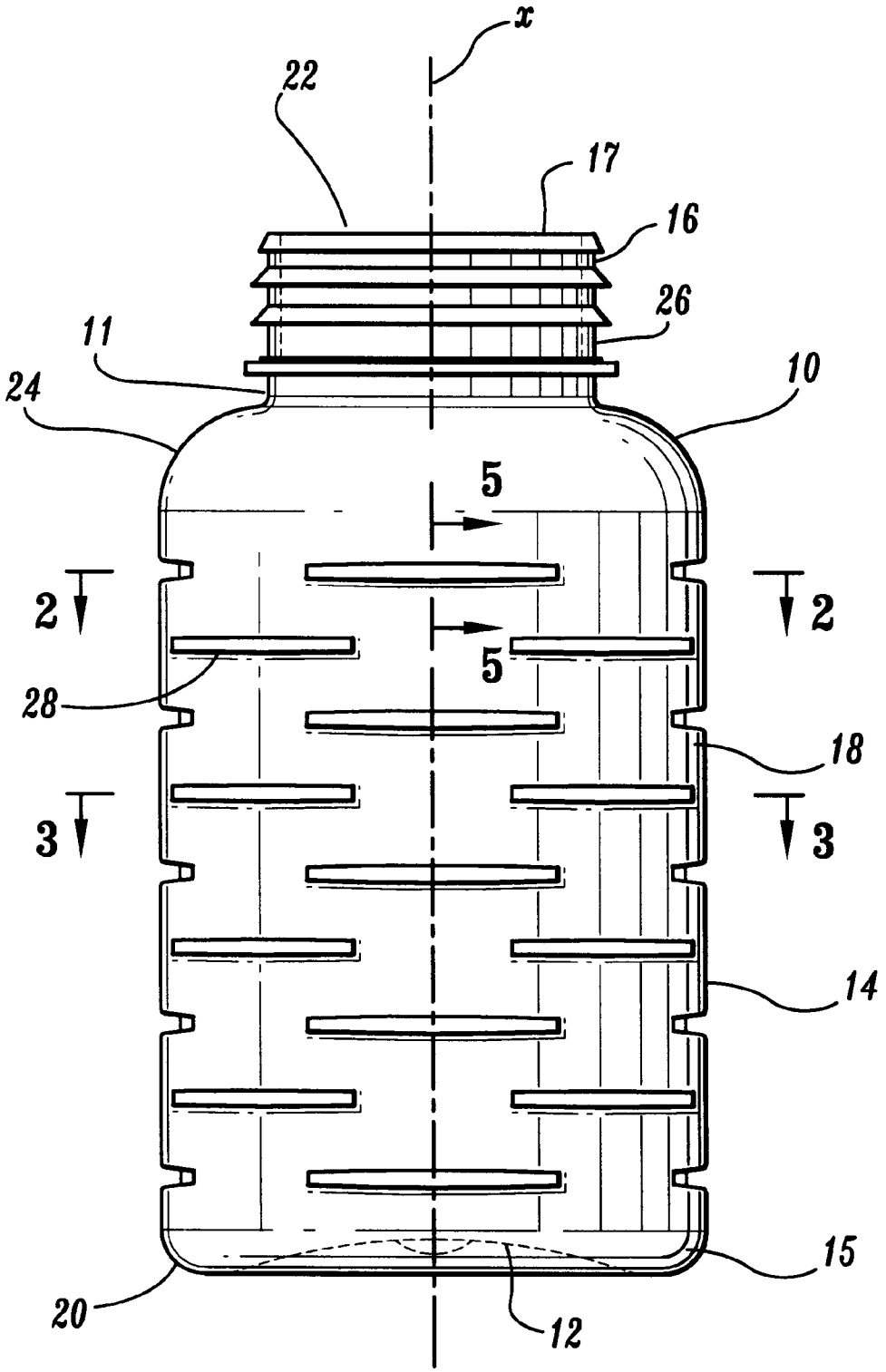
FIG. 1 is a side plan view illustrating a container in accordance with one embodiment of the present disclosure.

The exemplary embodiments of the apparatus and methods disclosed herein are discussed in terms of plastic containers. It is envisioned, however, that the disclosure is applicable to a wide variety of containers and vessels which require enhancement of axial or radial strength and rigidity. It is believed that the present disclosure finds application in various cylindrical objects such as piping, columns or cylinders, paper/plastic cups and packaging material, which require added strength and rigidity in axial and/or side wall deflection without the added requirements of additional panel wall thickness.

In the discussion which follows, the term "container"refers, but is not limited to, blow molded plastic bottles which employ snap-on, pushed-on, screw-on, etc., cap structures. It is important to note, however, that the present disclosure is readily applicable to containers, bottles, cups, dishes and cookware, e.g., TUPPERWARE®, which would have the benefit of applying the present disclosure to provide added top load and deflection rigidity to the side walls thereof.

Reference will now be made in detail to the embodiments of the present disclosure that are illustrated in the accompanying figures. Turning now to the figures, wherein like components are designated by like reference numerals throughout the several views, attention is initially directed to FIG. 1. A container 10, in accordance with the present disclosure, includes a top portion 11, a bottom portion 12, and a side wall 14. Side wall 14 extends from top portion 11 to an end portion 15 of side wall 14. Bottom portion 12 is connected with end portion 15 of side wall 14 such that top portion 11, side wall 14 and bottom portion 12 define an interior space 17 of container 10. Top portion 11 defines a mouth 16 having an opening 22 for adding or removing a substance from interior space 17.

Figure 6:
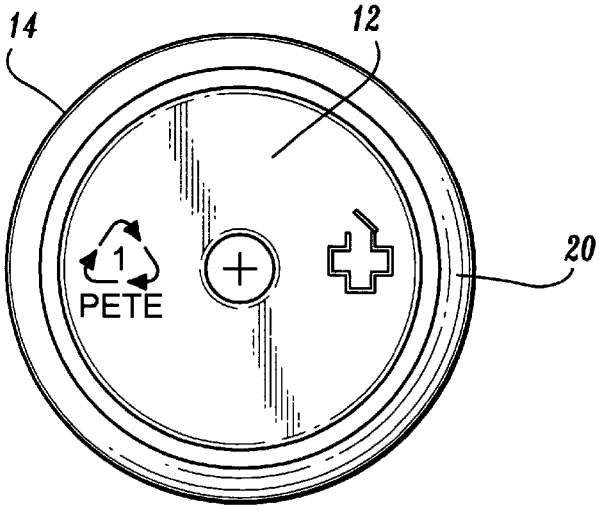
FIG. 6 is a bottom plan view of the container shown in FIG. 1.

Side wall 14 includes an outer surface 18 having an arcuate cross section. Alternatively, container 10 may be rectangular, pentagonal, etc., such that outer surfaces 18 are planar. End portion 15 of side wall 14 connects with a bottom shoulder 20 whereby side wall 14 is connected to bottom portion 12, as shown in FIG. 6.

Referring back to FIG. 1, bottom shoulder 20 has an arcuate configuration to reduce stress concentration at the bottom corners of container 10. It is envisioned that container 10 may be designed without a shoulder wherein a sharp angle is formed between side wall 14 and bottom portion 12. It is further envisioned that bottom shoulder 20 may have varying degrees of curvature depending on the particular container application. Bottom portion 12 has an inwardly arcuate configuration which is convex relative to interior space 17 of container 10. It is contemplated that bottom portion 12 may be flat, domed, inwardly recessed, etc., in a suitable configuration for container applications.

Mouth 16 has a diameter which is smaller than the diameter of outer surface 18. Side wall 14 has a curvature adjacent top portion 11 forming a top shoulder 24 which has a decreasing diameter, up to a neck 26. Alternatively, container 10 may be formed without top shoulder 24 or neck 26. For example, container 10 may have a mouth 16 with a diameter which is equal to the diameter of outer surface 18.

Container 10 is blow molded using plastic materials suitable for container applications, such as, for example, PET (polyethylene terephthalate) material. Other polymerics are also contemplated. One skilled in the art, however, will realize that other materials and fabrication methods suitable for container manufacture, in accordance with the present disclosure, also would be appropriate.

A plurality of grooves 28 are formed in rows along outer surface 18 of side wall 14. Grooves 28 are disposed within an array of rows in a relative staggered configuration in an interrupted configuration such that portions of outer surface 18 are disposed between grooves 28. The rows lie in parallel planes transverse to a longitudinal axis x of container 10. It is contemplated that at least one groove is employed with container 10 and the quantity of grooves 28 may be varied according to the strength and rigidity requirements of a particular container application.

Figure 2:
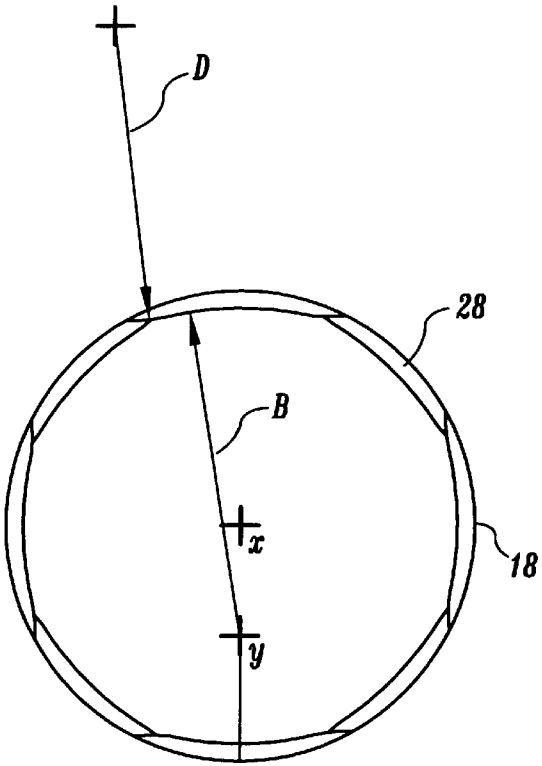
FIG. 2 is a cross-sectional view of the container shown in FIG. 1 taken along lines II—II.
Figure 4:
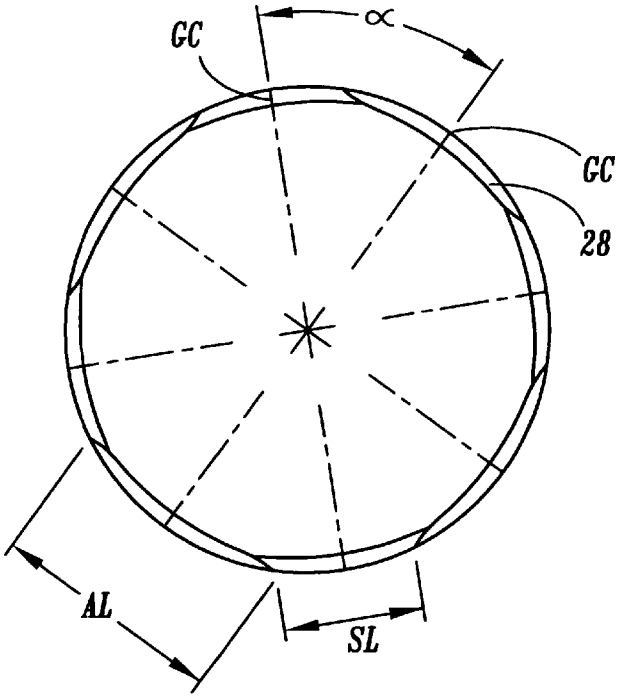
FIG. 4 is a cross-sectional view of the container of FIG. 1 taken along lines II—II.

Referring to FIG. 2, grooves 28 are interrupted about outer surface 18 such that in cross section, grooves 28 appear to overlap. Grooves 28 are spatially oriented in the staggered rows along outer surface 18 such that a groove center GC of grooves 28 is angularly displaced an angle $\alpha$ of 45 degrees, as shown in FIG. 4. It is contemplated that $\alpha$ may have other angular displacements according to a particular container application.

Figure 7A:
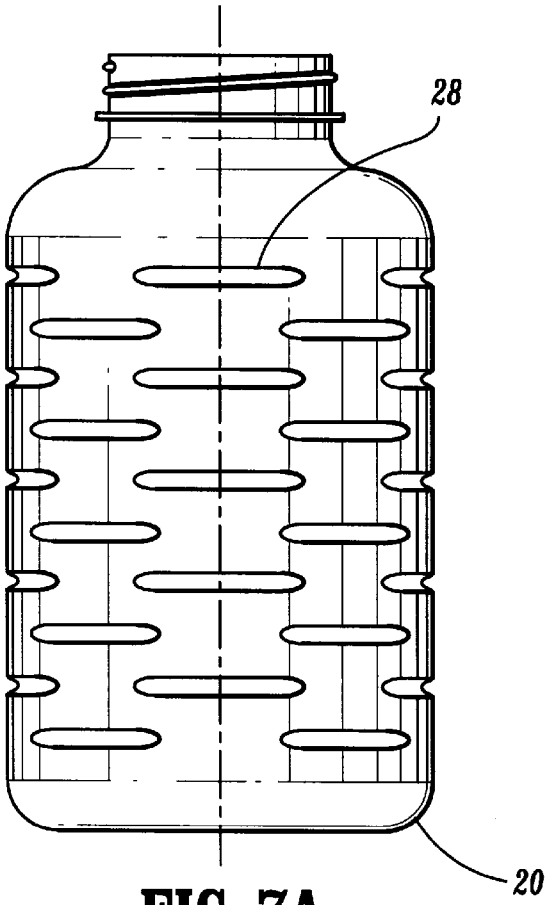
FIG. 7A is a side plan view illustrating an alternate embodiment of the container.
Figure 7B:
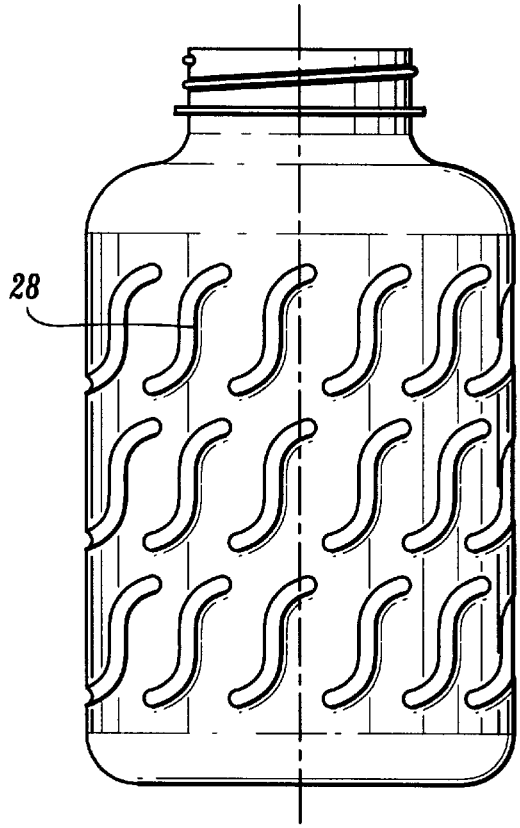
FIG. 7B is a side plan view illustrating another alternate embodiment of the container.
Figure 7C:
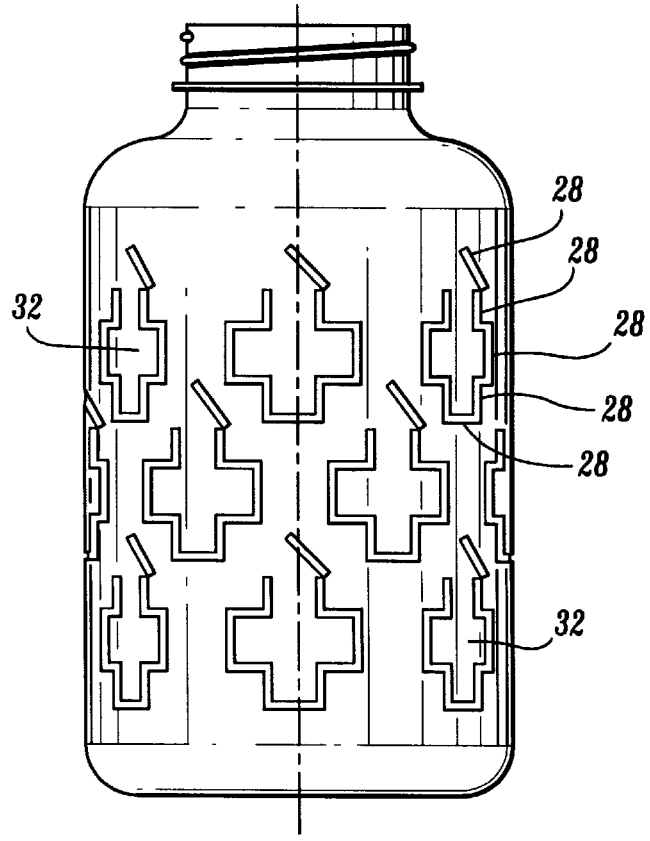
FIG. 7C is a side plan view illustrating yet another embodiment of the container.

Grooves 28 have a substantially linear configuration. It is envisioned that grooves 28 may have alternate configurations. For example, as shown in FIG. 7A, grooves 28 have a substantially elliptical configuration. Referring to FIG. 7B, grooves 28 have an S-shaped, substantially undulating configuration. In yet another embodiment, as shown in FIG. 7C, grooves 28 cooperate to form an array of patterns 32.

Referring back to FIG. 1, grooves 28 are formed in a staggered configuration to create a continuous load stress path communicating with outer surface 18 of side wall 14 along longitudinal axis x of container 10. The longitudinal stress paths are components of a web of stress paths formed by the smooth and continuous portions of outer surface 18 of side wall 14. The exemplary embodiments of the present disclosure include staggered rows of grooves 28 to distribute the longitudinal stiffness evenly around outer surface 18. It is envisioned that grooves 28 may be combined and/or arranged in various patterns according to the strength and/or rigidity requirements of a particular container application.

Referring back to FIG. 4, grooves 28 have an arcuate length AL which is contemplated to be greater than or equal to a length of spacing SL between grooves 28 in a particular row. For example, arcuate length AL=1.086 and spacing length SL=0.0683 in the particular container application shown. It is desirable that arcuate length AL have a greater dimension than spacing length SL to advantageously provide load and stress compensation for an applied load, however, other dimensional ratios of arcuate length AL and spacing length SL may be used. Arcuate length AL and spacing length SL of grooves 28 may be advantageously varied to facilitate load and stress compensation for a particular container application.

Figure 3:
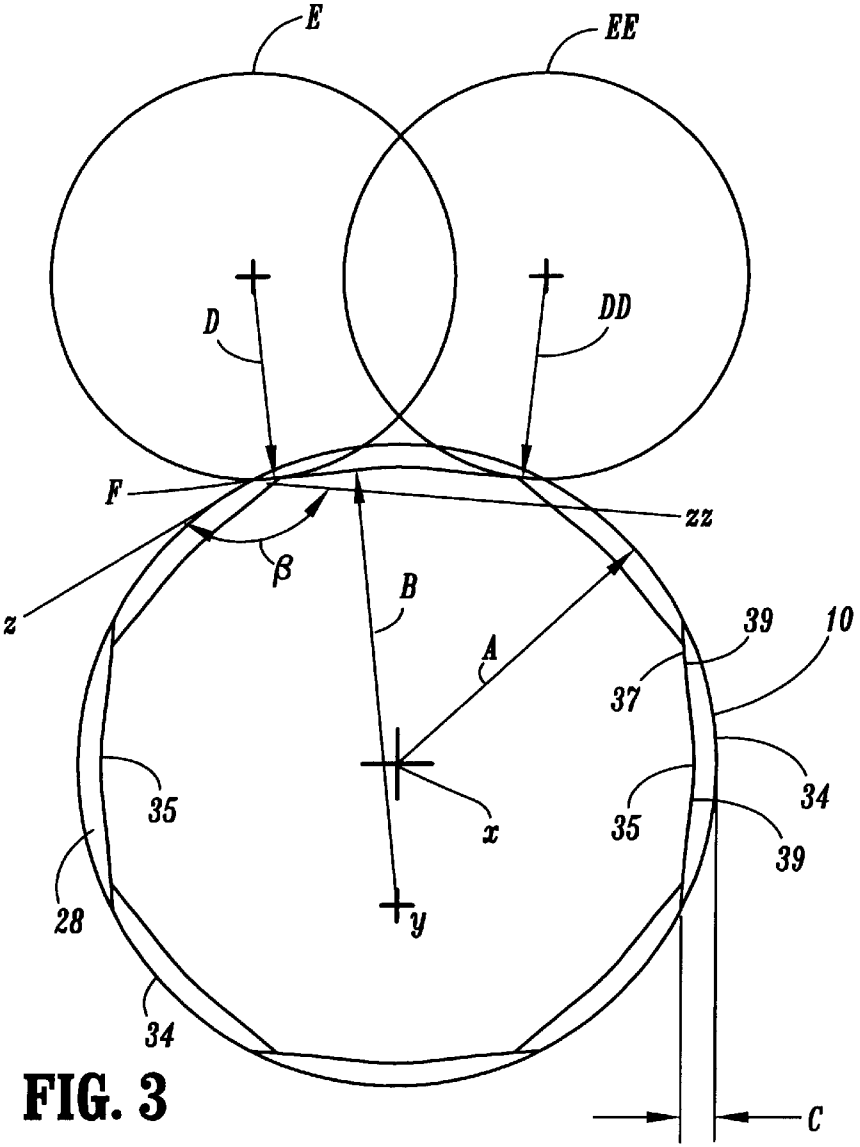
FIG. 3 is a cross-sectional view of the container shown in FIG. 1 taken along lines IV—IV.

Referring to FIG. 3, the configuration of grooves 28 advantageously increase geometric strength and resistance to the deflection of side wall 14(FIG.1). Grooves 28 utilize a plurality of arcuate portions having variously dimensioned radii to accomplish these and other advantages, as will be discussed below. Outer surface 18 defines an outer arc 34 which corresponds to arcuate length AL(FIG.4) of grooves 28. Outer arcs 34 lie on a circle defined by outer surface 18. Outer arcs 34 correspond to a radius A measured from longitudinal axis x of container 10. Outer arcs 34 have a concave orientation relative to longitudinal axis x of container 10. Grooves 28 define a central arc portion 35 which forms a circle having a first radius, such as, for example, a radius B measured from an axis y which is offset from longitudinal axis x of container 10.

Central arc portion 35 has a shorter arc length than outer arc 34 due to the substantially undulating configuration of grooves 28 as central arc portion translates to end arc portions of grooves 28, discussed below. The relative arc lengths of outer arc 34 and central arc portion 35 may be modified according to the strength and rigidity requirements of a particular container application. The difference between radius A and radius B defines a dimensional depth C of a substantial portion of grooves 28.

Grooves 28 include end arc portions 37 formed adjacent ends of central arc portion 35 and communicate with outer surface 18 of side wall 14. End arc portions 37 communicate with outer surface 18 to form, at least in part, a load stress path, as discussed. End arc portions 37 translate from central arc portion 35 adjacent terminating ends of central arc portion 35 at inflection points 39.

End arc portions 37 form circles E and EE, respectively, having a second radius, such as, for example, a radius D and a third radius, such as, for example, a radius DD, respectively, as measured from their respective longitudinal axes. The axes of circles E and EE are dimensioned equidistant from longitudinal axis x of container 10.

End arc portions 37 have a convex orientation relative to longitudinal axis x of container 10. The arc lengths and radii associated with grooves 28 may be altered to provide varying strength and degrees of rigidity according to the particular container application. It is contemplated that central arc portion 35 has a radius B equal to 1.625 inches and end arc portions 37 have radii D and DD each equal to 1.490 inches. It is contemplated that radius B is greater than radius D and radius DD. It is also contemplated that radii D and DD may be of unequal dimension.

Grooves 28 are formed in a staggered row arrangement with container 10 along longitudinal axis x. Outer arcs 34 and end arc portions 37, disposed in the alternate rows of grooves 28, cooperate adjacent an intersection point F adjacent outside surface 18 at an oblique angle $\beta$. Angle $\beta$ is measured from a tangent reference axis z of outer arc 34 and a tangent reference axis zz of end arc portion 37.

Upon application of an axial and/or a lateral load, inflection points 39, central arc portion 35 and end arc portions 37 facilitate a load path which translates stress towards outside surface 18 due, at least in part, to the orientation of oblique angle $\beta$, at which point load stress is uniformly directed along outer surface 18 of container 10. This feature advantageously facilitates load and stress compensation of container 10 for axial and lateral loads applied. Outer arc 34 of outer surface 18, and central arc portion 35 and end arc portions 37 of grooves 28 cooperate by providing a stress path that communicates stress from applied loads therebetween and along outer surface 18 of container 10.

Figure 5:
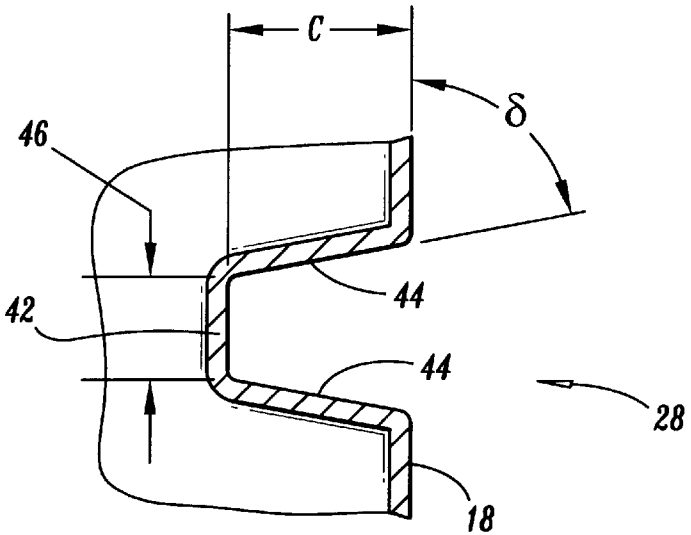
FIG. 5 is a cross-sectional view of the container of FIG. 1 taken along lines V—V.
Figure 5A:
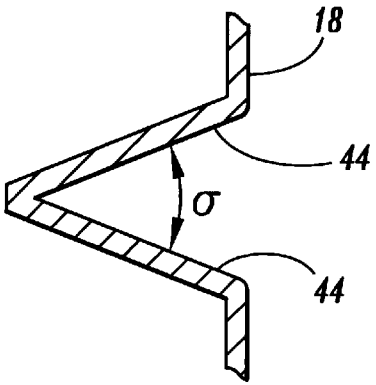
FIG. 5A is a cross-sectional view of an alternate embodiment of a plurality of grooves shown in FIG. 5.

Referring to FIG. 5, an alternate embodiment of grooves 28 of container 10 is shown. Grooves 28 define a cross-sectional configuration having groove walls 44 extending, inward from outer surface 18 to a groove floor 42. Groove walls 44 extend inwardly a depth C, as discussed with regard to FIG. 3. Groove floor 42 has a floor width 46. Groove walls 44 are oriented at a wall angle $\delta$ measured from outer surface 18. This configuration advantageously provides load and stress compensation for container 10 in response to lateral, axial loads, etc., applied. It is envisioned that grooves 28 may also have an arcuate, bell-shaped, etc., cross-section.

Variations of floor width 46 and wall angle δ affect structural rigidity of container 10 to prevent failure of side walls 14 in response to applied loads. It is envisioned that suitable dimensions may include floor width 46 equal to 0.050 inches and wall angle δ equal to 80 degrees. It is contemplated that other dimensions and other angular orientations may be used according to the strength and rigidity of requirements of a particular container application.

Structural rigidity is increased as depth C increases and/or angle δ approaches 90 degrees. It is contemplated that grooves 28 may only include groove walls 44 that converge having an acute wall angle δ. In another alternate embodiment, grooves 28 define a cross-sectional configuration having groove walls 44 extending inward from outer surface 18 to a convergence position 50. Groove walls 44 form an acute wall angle a such that grooves 28 form a substantially V-shaped cross-sectional configuration. It is envisioned that acute wall angle σ may have various angular orientations according to the strength and rigidity requirements of a particular container application.

While the illustrative. embodiments provided herein refer to containers made from plastic materials, it will be understood by one skilled in the art that other materials could be employed, such as metals, paper/cardboard, glass, etc.

It will be understood that various modifications may be made to the embodiments disclosed herein. For example, the grooves can be employed in any wall member which requires added deflective and/or axial rigidity. Also, the respective ratios of the radii may be altered in manners which provide higher or lower. rigidity, depending on the strength and rigidity requirements of a particular container application. Therefore, the above description should not be construed as limiting, but merely as exemplifications of preferred embodiments. Those skilled in the art will envision other modifications within the scope and spirit of the claims appended hereto.

What is claimed is:

1. A container comprising:

a top portion having an opening;

a side wall extending from the top portion to an end portion of the side wall;

a bottom portion being connected with the end portion of the side wall such that the top portion, the side wall and the bottom portion define an interior space of the container;

a plurality of grooves formed in rows along the side wall and a longitudinal axis of the container, the grooves each defining a groove center such that in a cross section of the container, which is transverse relative to the longitudinal axis, the grooves overlap whereby the groove centers are angularly displaced approximately 45 degrees from groove centers of grooves in a successive row, the grooves including substantially rigid central arc and end arc portions, the central arc portion being substantially concave relative to a longitudinal axis of the container and the end arc portions being substantially convex relative to the longitudinal axis of the container, the end arc portions being formed adjacent ends of the central arc portion and communicating with an outer surface of the side wall, whereby in the cross section the end arc portions intersect with the end arc portions in successive rows to form intersection points; and the grooves forming a load path means for uniformly translating stress to the outer surface of the side wall, wherein the load path means includes the groove overlap and intersection points which form a web of longitudinal stress paths.

2. A container as set forth in claim 1, wherein the central arc portion and the end arc portions are formed having a substantially undulating cross-sectional configuration.

3. A container as set forth in claim 1, wherein the plurality of grooves form rows along the outer surface of the side wall, the rows lying in planes transverse to the longitudinal axis of the container.

4. A container as set forth in claim 3, wherein the plurality of grooves are disposed within the rows in an interrupted configuration such that at least a portion of the outer surface is disposed between the plurality of grooves.

5. A container as set forth in claim 3, wherein the rows lie in parallel transverse planes relative to the longitudinal axis of the container.

6. A container as set forth in claim 3, wherein the plurality of grooves are disposed in the rows in a relative staggered configuration.

7. A container as set forth in claim 1, wherein the central arc portion forms a circle having a first radius and the end arc portions form circles having a second radius and a third radius, respectively.

8. A container as set forth in claim 7, wherein the first radius is greater than the second radius and the third radius.

9. A container as set forth in claim 7, wherein the second radius and the third radius are substantially equal.

10. A container as set forth in claim 7, wherein the first radius is measured from an axis offset from the longitudinal axis of the container.

11. A container as set forth in claim 1, wherein the grooves are formed of substantially linear segments in the outer surface of the side wall.

12. A container as set forth in claim 1, wherein the grooves have a substantially undulating configuration formed in the outer surface of the side wall.

13. A container as set forth in claim 1, wherein the central arc portion and the end arc portions are cooperatively formed to create a load stress path communicating with the outer surface of the side wall for a load applied to the container.

14. A container as set forth in claim 13, wherein the central arc portion communicates a load stress against a load stress communicated from the end arc portions along the load stress path.

15. A container as set forth in claim 1, wherein at least one groove defines a cross-sectional configuration having groove walls extending inward from the outer surface to a groove floor, the groove walls being oriented at a wall angle measured from the outer surface.

16. A container as set forth in claim 1, wherein at least one groove defines a cross-sectional sectional configuration having groove walls extending inward from the outer surface to a convergence position such that the at least one groove has a substantially V-shaped cross-sectional configuration.

17. A plastic container comprising:

a top portion including a neck portion having an opening;

a side wall extending from the top portion to an end portion of the side wall; a bottom portion being connected with the end portion of the side wall such that the top portion, the side wall and the bottom portion define an interior space of the container;

a plurality of grooves being formed in rows along an outer surface of the side wall and defining groove centers such that in a cross section of the plastic container, which is transverse relative to a longitudinal axis of the plastic container, the grooves overlap whereby the groove centers are angularly displaced approximately 45 degrees from groove centers of grooves in a successive row, the rows lying in planes transverse to the longitudinal axis of the container, the plurality of grooves being disposed within the rows in an interrupted configuration about the outer surface of the side wall such that the rows are staggered, wherein the plurality of grooves include substantially rigid central arc and end arc portions, the central arc portion being substantially concave relative to the longitudinal axis of the container and forming a circle having a first radius substantially equal to 1.625 inches, the end arc portions being substantially convex relative to the longitudinal axis of the container, the end arc portions being formed adjacent ends of the central arc portion and communicating with the outer surface of the container, the end arc portions forming circles having a second and a third radius substantially equal to 1.490 inches, respectively, the second and third radii being substantially equal, the plurality of grooves defining a cross-sectional configuration having groove walls extending inward from the outer surface of the container to a groove floor having a width substantially equal to 0.050 inches, the groove walls forming a wall angle with the groove floor, whereby in the cross section the end arc portions intersect with the end arc portions in successive rows to form intersection points; and the grooves forming a load path means for uniformly translating stress to the outer surface of the side wall, wherein the load path means includes the groove overlap and intersection points which form a web of longitudinal stress paths.

18. A container as set forth in claim 17, wherein the wall angle is approximately 80 degrees.

19. A container as set forth in claim 1, wherein said load path means includes inflection points being formed at said adjacent ends of the central arc portion for uniformly translating stress to the outer surface of the side wall.

* * * * *